United States Patent [19]

Verheij et al.

[11] Patent Number: 4,979,598

[45] Date of Patent: Dec. 25, 1990

[54] SUITCASE FRAME

[75] Inventors: Johannes W. Verheij, Lisse; Irene P. van Peer, Utrecht, both of Netherlands

[73] Assignee: Homas N.V., Willemstad, Netherlands Antilles

[21] Appl. No.: 370,628

[22] Filed: Jun. 23, 1989

[30] Foreign Application Priority Data

Jun. 24, 1988 [NL] Netherlands ..... 8801617

[51] Int. Cl.[5] ..... A45C 5/14; A45C 7/00; A45C 13/26; A45C 13/38

[52] U.S. Cl. ..... 190/18 A; 190/108; 190/115; 190/103; 190/122; 280/37

[58] Field of Search ..... 190/18 A, 18 R, 108, 190/115, 103, 104, 122; 280/37, 38, 645

[56] References Cited

U.S. PATENT DOCUMENTS

| | | | |
|---|---|---|---|
| 234,496 | 11/1880 | Simmons | 190/18 A X |
| 588,721 | 8/1897 | Thomas | 190/18 A X |
| 854,602 | 5/1907 | Peterson | 190/18 A X |
| 1,752,948 | 4/1930 | Herrmann | 190/108 |
| 2,439,660 | 4/1948 | Keil | 190/18 A X |
| 2,510,754 | 6/1950 | Norlin | 280/38 |
| 2,581,417 | 1/1952 | Jones | 280/38 |
| 3,513,952 | 8/1968 | Warner, Jr. | 190/18 A X |
| 3,522,955 | 8/1970 | Warner, Jr. | 190/18 A X |
| 3,917,038 | 11/1975 | Foge et al. | 190/18 A |
| 4,087,102 | 5/1978 | Sprague | 280/37 |
| 4,122,925 | 10/1978 | Schultheiss | 190/108 |
| 4,254,850 | 3/1981 | Knowles | 190/18 A |
| 4,273,222 | 6/1981 | Cassimally et al. | 190/18 A |
| 4,411,343 | 10/1983 | Cassimally et al. | 190/18 A |

FOREIGN PATENT DOCUMENTS

| | | | |
|---|---|---|---|
| 2359229 | 6/1975 | Fed. Rep. of Germany | 190/18 A |
| 961977 | 5/1950 | France | 190/18 A |
| 1145985 | 11/1957 | France | 190/18 A |
| 2206064 | 6/1974 | France . | |
| 693373 | 7/1953 | United Kingdom | 190/18 A |
| 2168035 | 6/1986 | United Kingdom | 190/18 A |
| 2197637 | 5/1988 | United Kingdom | 190/18 A |

*Primary Examiner*—Sue A. Weaver

*Attorney, Agent, or Firm*—Webb, Burden, Ziesenheim & Webb

[57] ABSTRACT

A suitcase frame (1) provided with means to carry luggage and a document suitcase as well. The frame is provided with carrying wheels (6, 7) pivotable between a position inside the frame (1) and an operable position outside the frame (1). The wheels (6, 7) are actuated by the handle (10) of the suitcase frame (1).

22 Claims, 8 Drawing Sheets

SUITCASE FRAME

Figure 1:
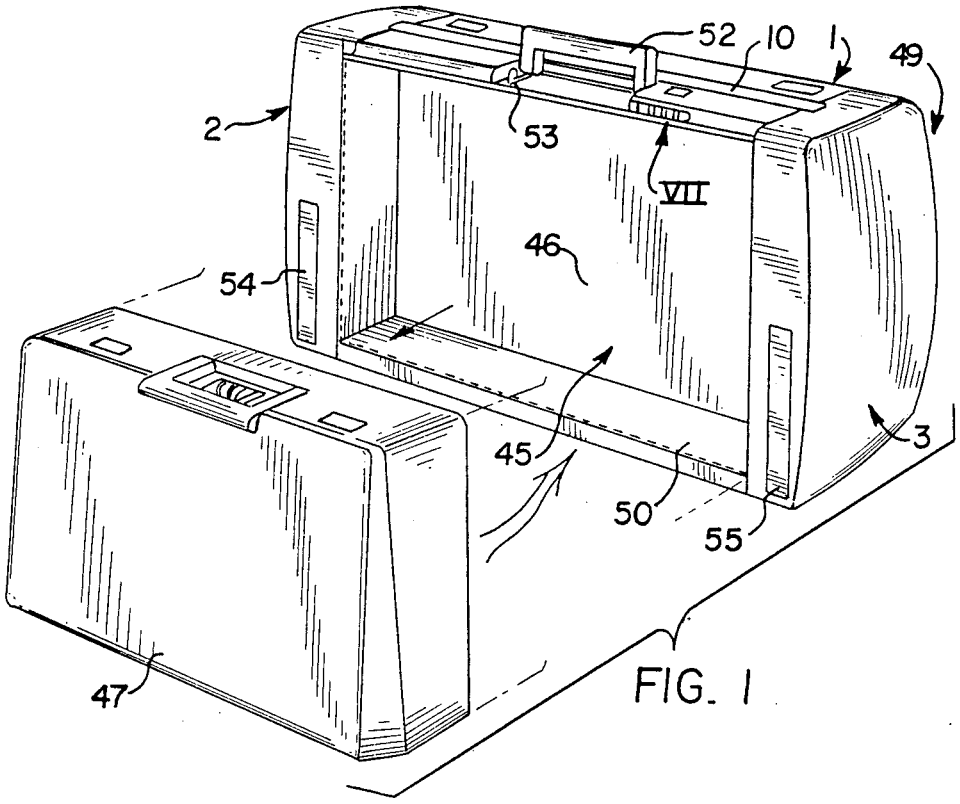

The invention relates to a suitcase frame. The transportation and handling of suitcases forms a continual problem for different reasons. If a large suitcase is chosen then one encounters the drawback that it becomes heavy and awkward to handle. An attempt has been made to solve this problem by providing larger suitcases with carrying wheels. However, small-size carrying wheels are chosen in order not to make the use of the suitcase awkward for the user. Because of this the suitcase rolls with difficulty when it is pulled along. Use is further made of portable folding framework-type frames onto which the suitcase is laid in order to enable it to be pulled along. The carrying of such a frame is awkward however. Moreover, certain requirements are made of suitcases in respect of the dimensions, particularly when these are used as so-called hand luggage in air traffic. If a suitcase is to be taken into the airplane then it must be stowable in the luggage space above the seating areas or under the seat or it has to be possible to place it against the edge of the seat covered by the legs of the seated passenger. Smaller suitcases do of course comply with this requirement but these have the drawback of limited carrying volume.

The invention has for its object to provide a suitcase which, in view of the dimensions thereof, can be used as so-called hand luggage, has a reasonable, preferably divisible capacity, on the one side for instance for clothing, and on the other side for documents, and which can moreover be transported without all too great a physical effort.

This is achieved by using a suitcase frame, consisting of double walls arranged parallel to and at a distance from each other, a carrying wheel in each of the double walls pivotable between a rest position in the double wall and an active position outside that space and an actuating system for causing the carrying wheels to pivot.

With such a suitcase frame there is the possibility of causing the carrying wheels to pivot outwards for transportation and of making the suitcase roll forwards, and, for the non-transporting position, of causing the wheels to pivot into the space between the double walls so that the suitcase can be handled like any other suitcase.

The actuating system is preferably coupled to a bracket slidable in lengthwise direction of the walls, such that when the bracket is extended the carrying wheels are in the position outside the space in the double walls and when the bracket is retracted the carrying wheels are inside this space.

The bracket, which is for example U-shaped and whereby each leg of the U is inserted into a double wall, is used as both actuator for the actuating system for the carrying wheels and in extended position as pulling bracket for transporting the suitcase. In order to achieve a sufficient length for the pulling bracket the legs preferably consist of telescopically extendable parts. For enabling the bracket to withstand compressing loads encountered during use, the bracket is preferably provided with means for fixing it in its fully extended position.

As well as performing a pivoting movement while swivelling into the active position the rotating shafts of the carrying wheels also perform a translation movement.

Owing to the coupling of the extension movement of the pulling bracket and the pivoting of the carrying wheels to or from the active position both the pivoting movement of the carrying wheels and the extension movement of the legs of the U-shaped bracket are synchronized. This is important since if extension of the legs of the U is non-synchronized there is the danger that they will go out of square and jam.

Arranged between the walls of the frame is a first suitcase. A second suitcase can be detachably arranged against the bottom wall of the first suitcase. The first suitcase can thereby be a clothing suitcase for example, while the second suitcase can be a so-called attache case. The first suitcase can have a moveable bottom connected to the side walls over a bellows construction. In the absence of the second attache case the bottom wall of the first suitcase can be brought outwards so that the loading space is enlarged. The first suitcase preferably has a rounded upper wall such that when the suitcase frame with suitcase is disposed on the floor against the seat for example of an airplane seat the user is not thereby obstructed since the suitcase matches the shape of the seat.

Figure 3:
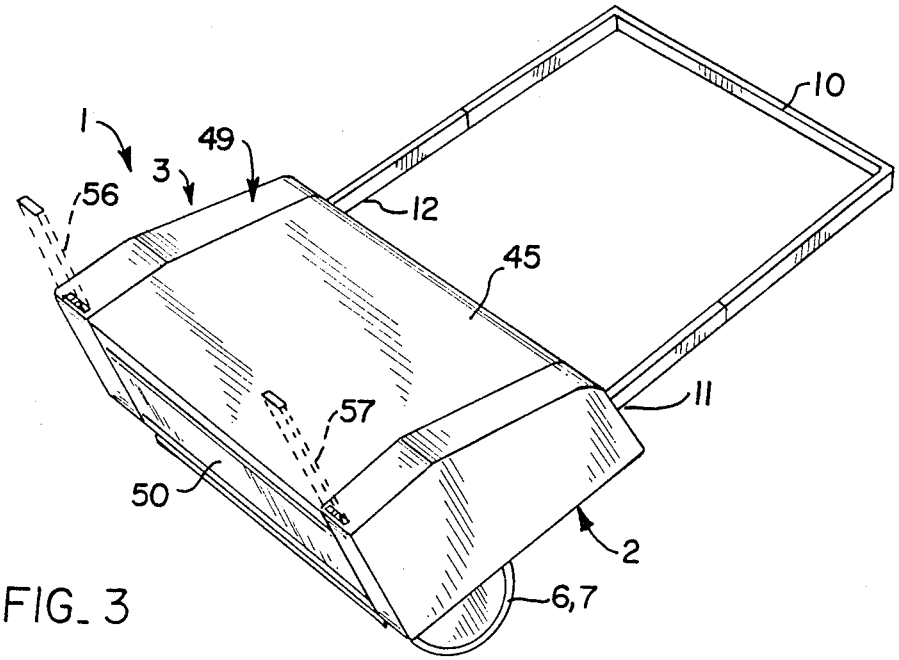
Figure 2:
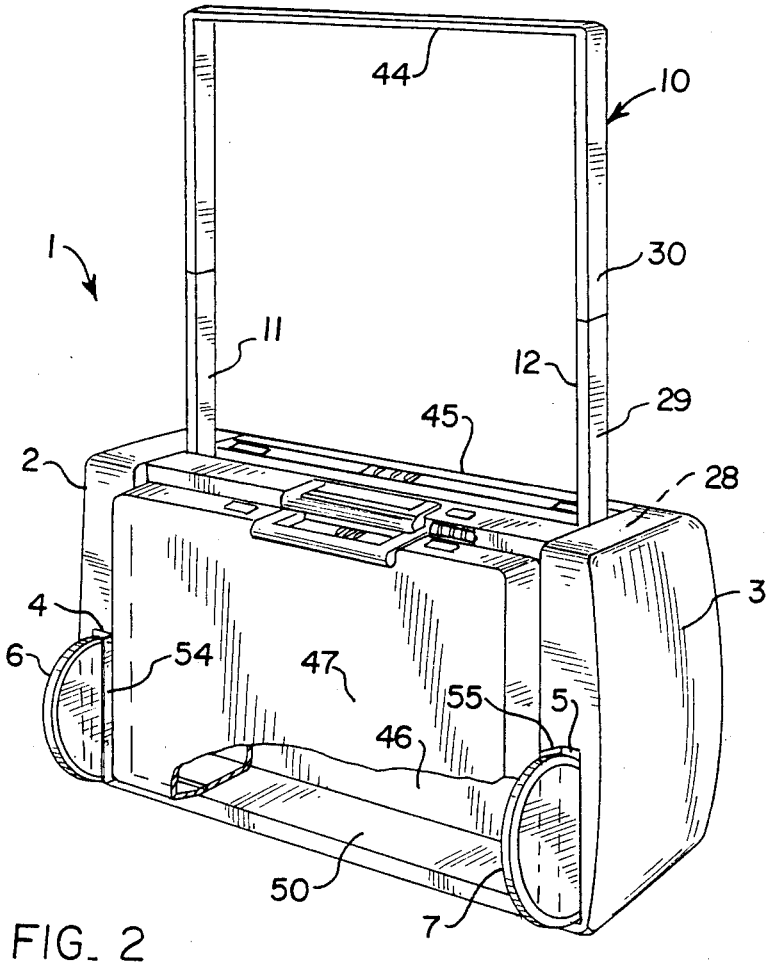
Figure 4:
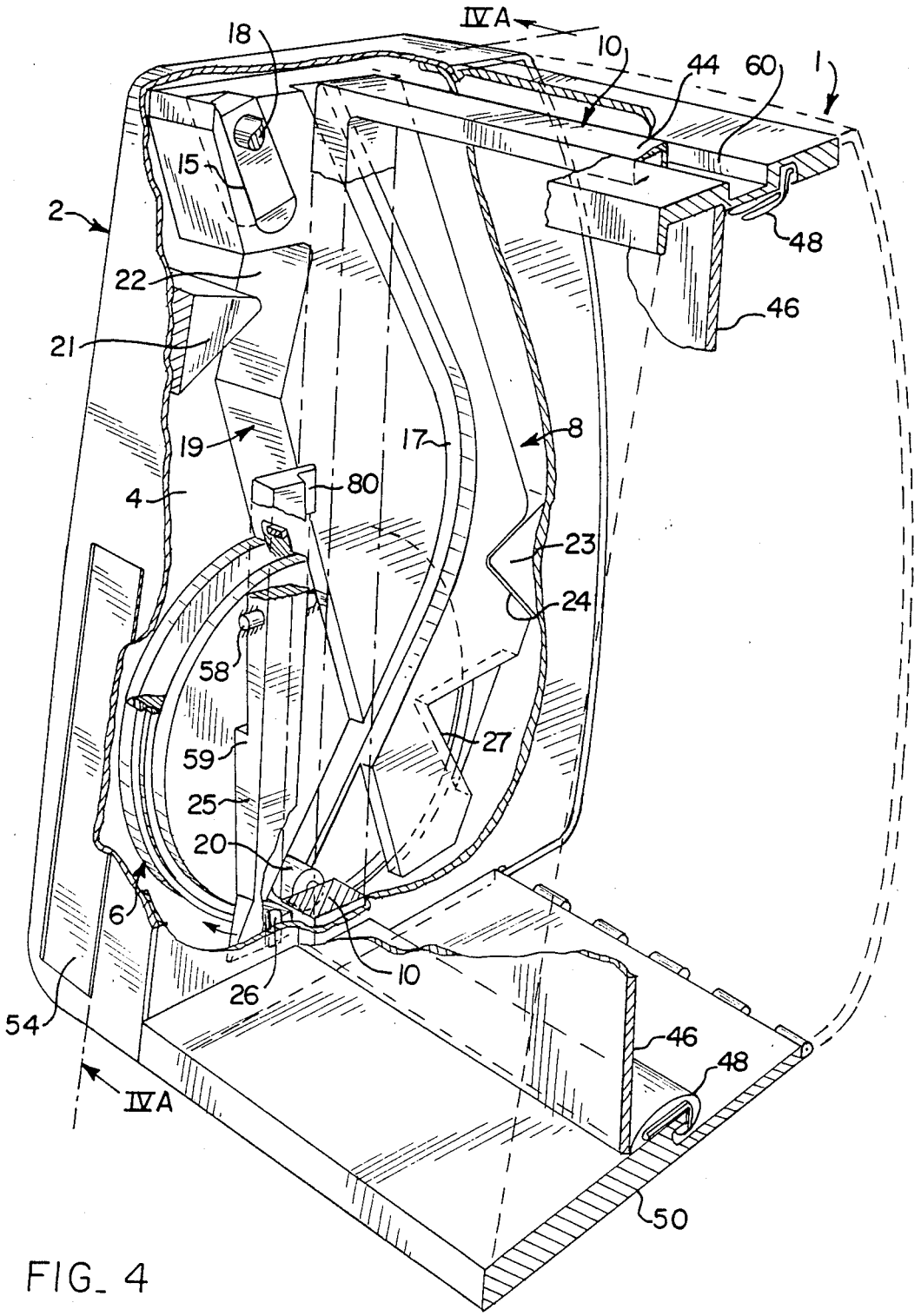
Figure 4C:
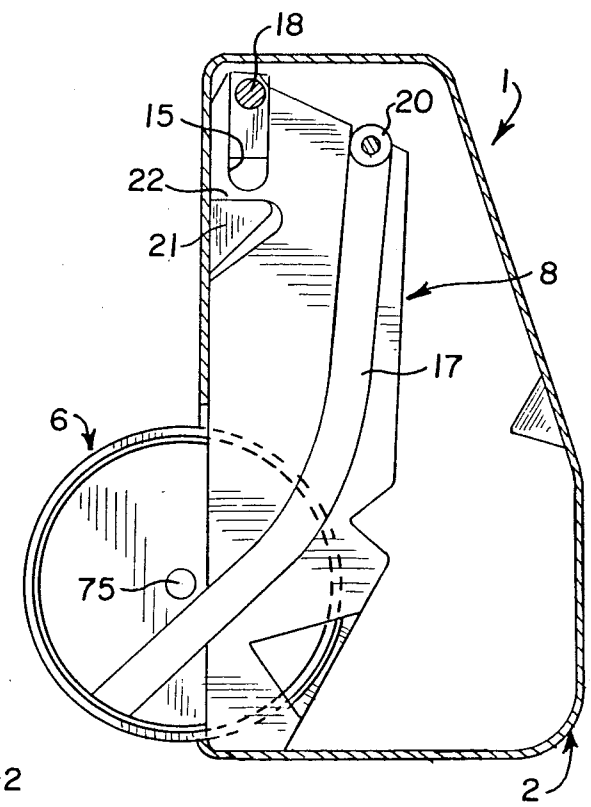
Figure 4B:
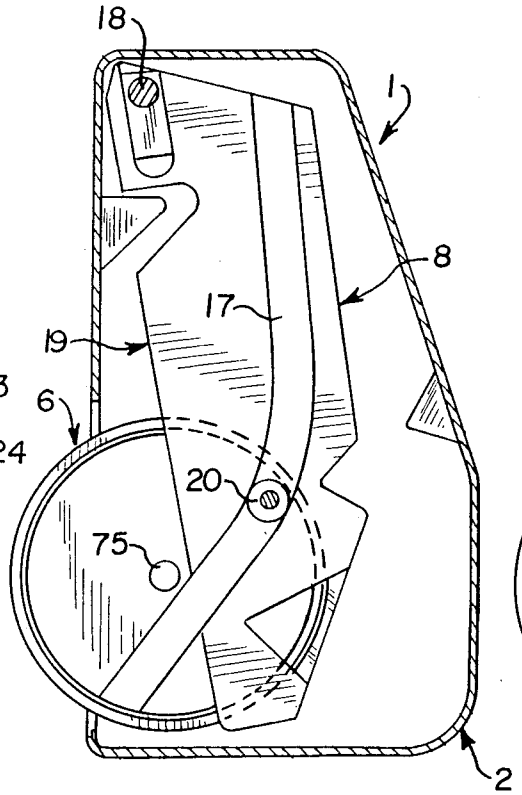
Figure 4A:
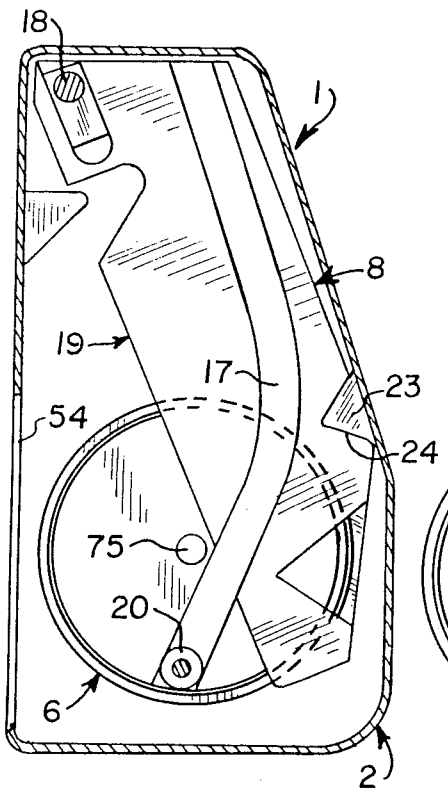
Figure 5:
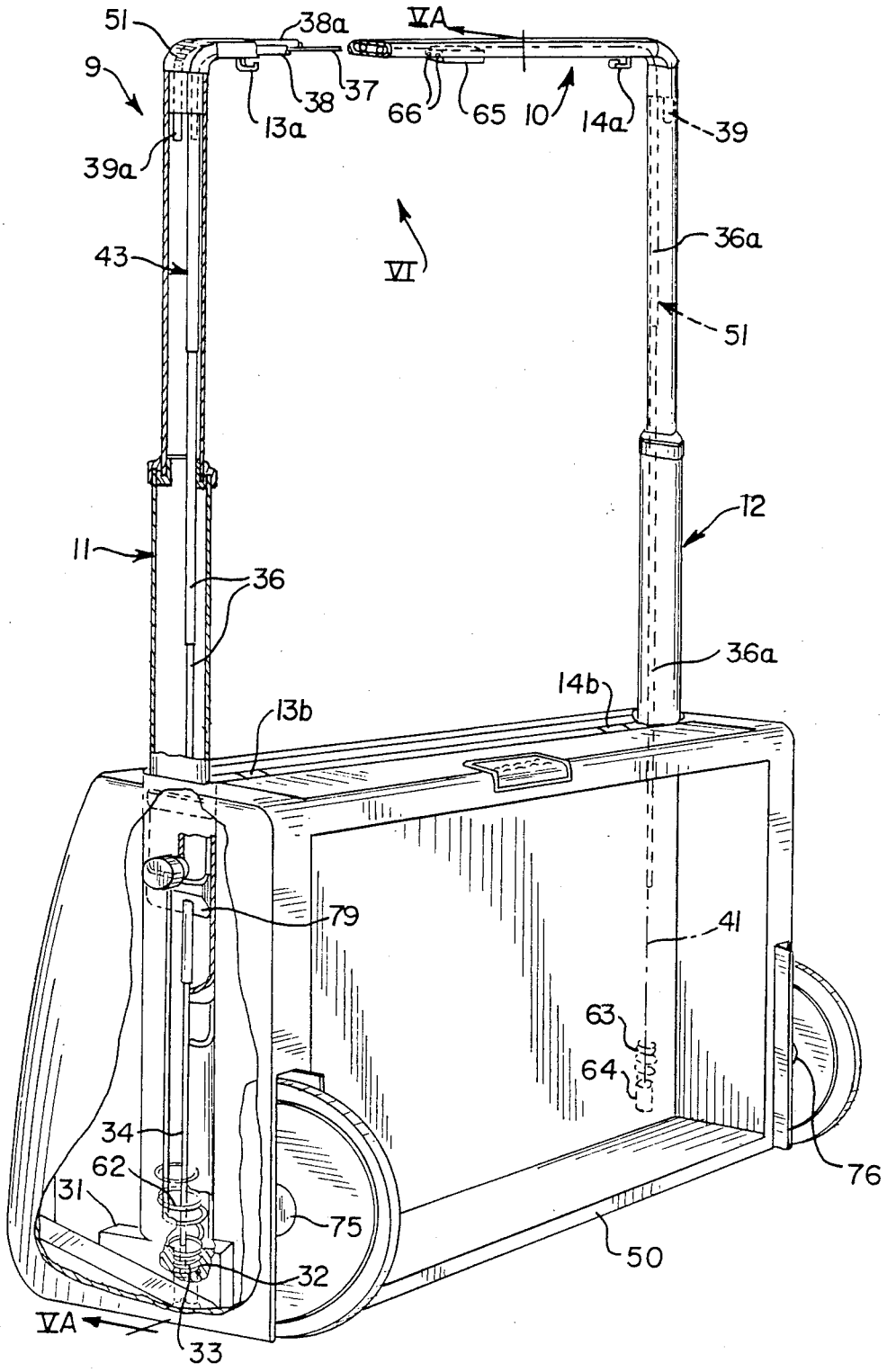
Figure 5A:
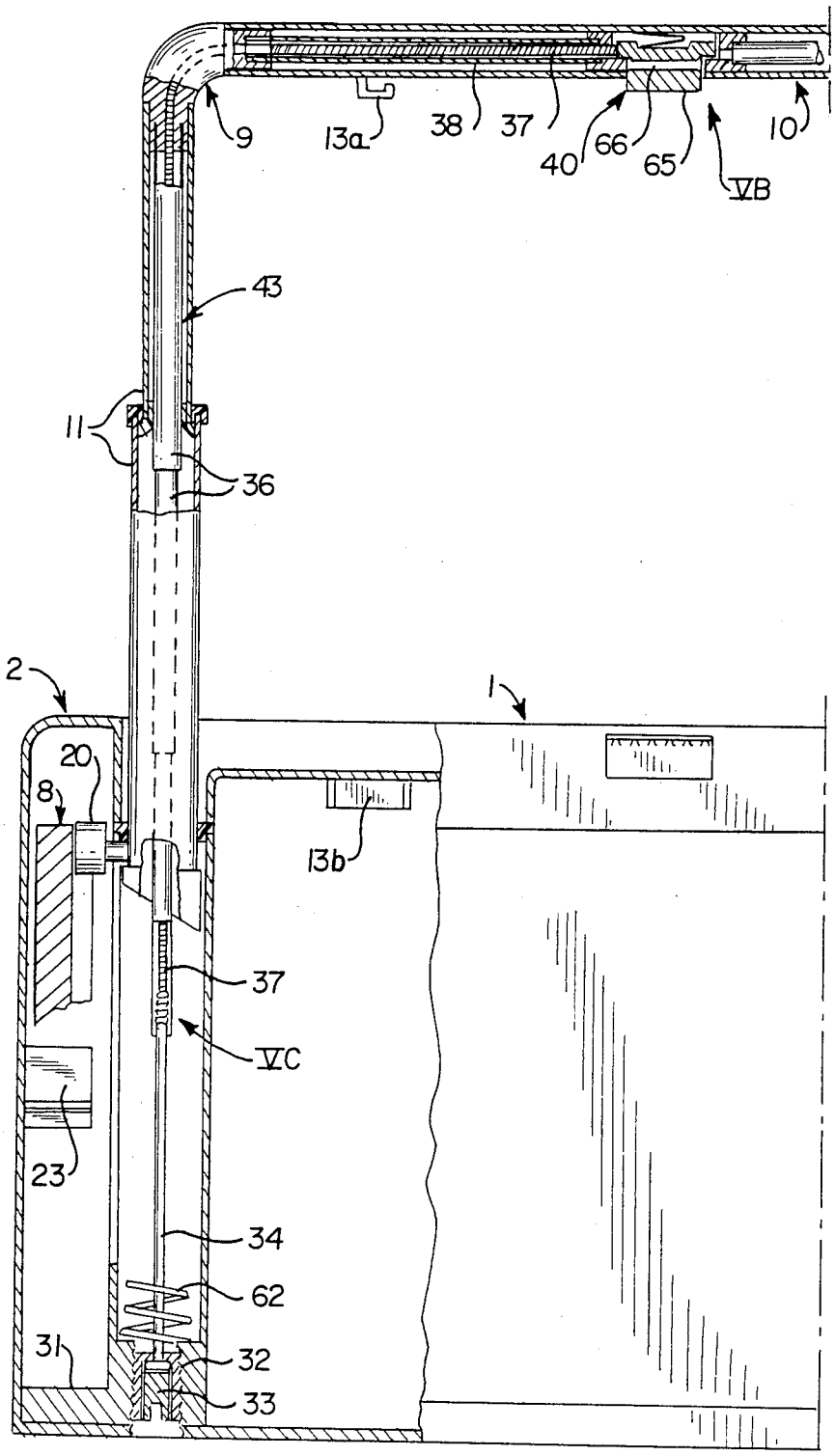
Figure 5B:
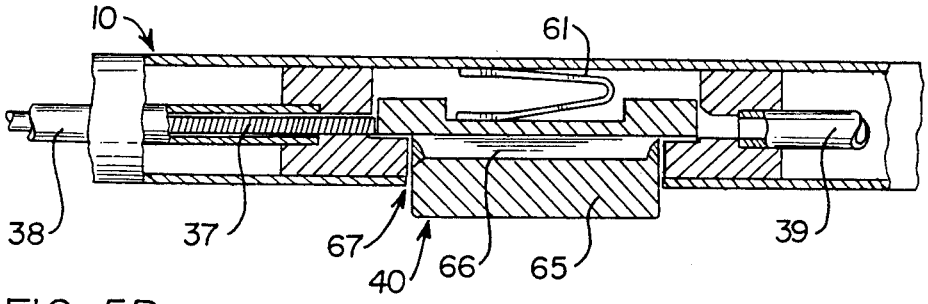
Figure 5C:
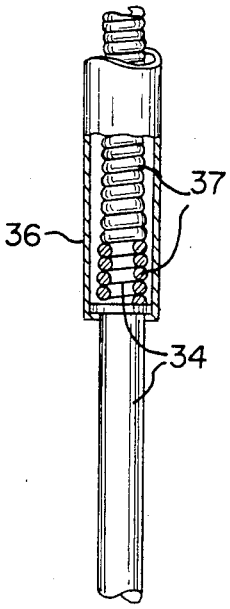
Figures 6, 7:
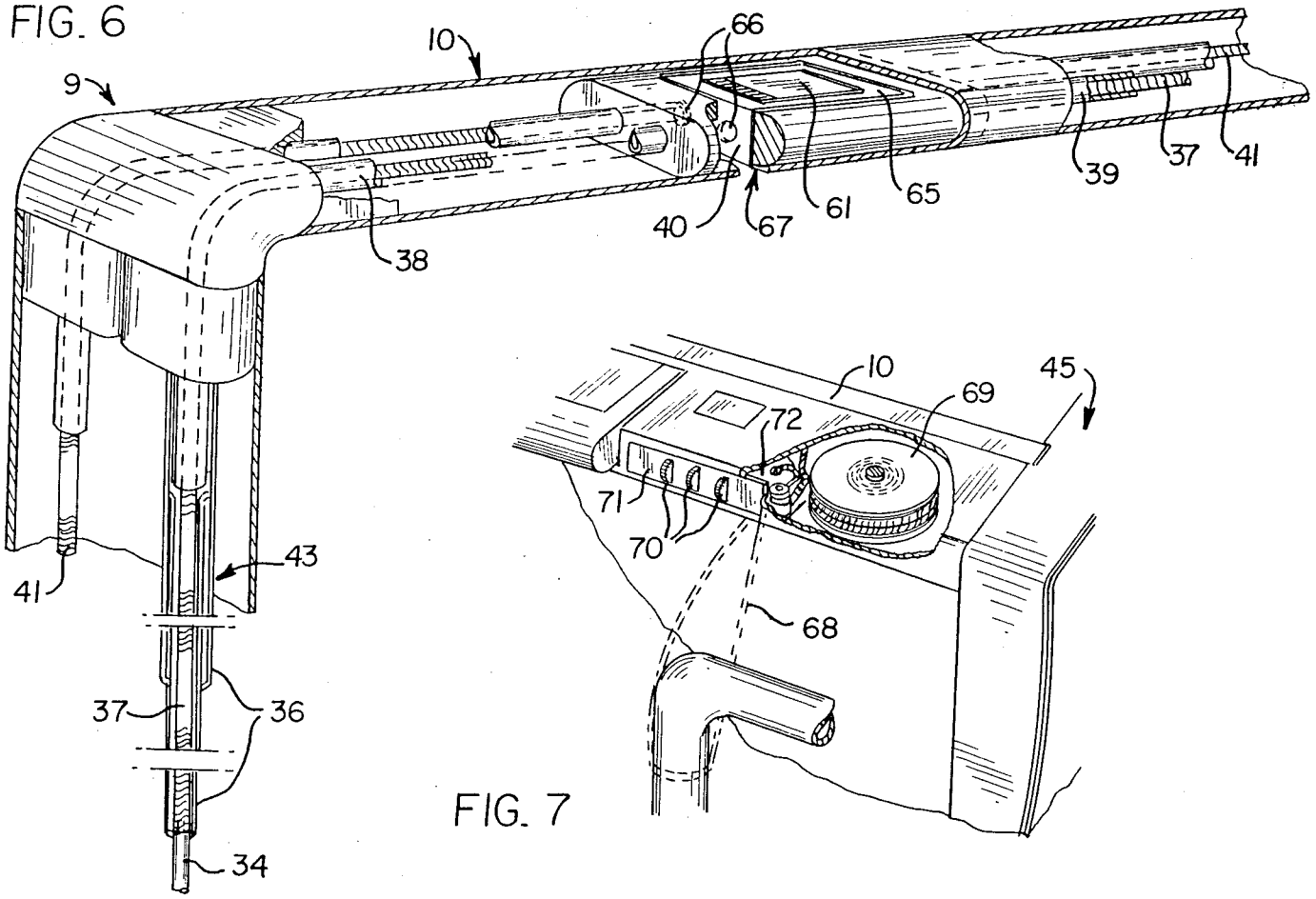

Other features and advantages of the invention will become apparent from the description of embodiments as according to the annexed drawings. In the drawings:

FIG. 1 shows in perspective view and in dismantled state the suitcase frame with two suitcases arranged therein, FIG. 2 shows the suitcase frame according to the invention with extended bracket and carrying wheels moved outwards, FIG. 3 shows in perspective view the suitcase frame in the transporting position, FIG. 4 shows in perspective view an embodiment of the actuating system for the carrying wheels, FIG. 4A shows a side view partially in section of the actuating system for the carrying case where the wheels are in a rest position, FIG. 4B shows a side view partially in section of the actuating system of FIG. 4A where the carrying wheels are in a partial active position, FIG. 4C shows a side view partially in section of the actuating system of FIG. 4A where the wheels are in an active position, FIG. 5 shows a partial sectional perspective view of the suitcase frame in the transporting position, FIG. 5A shows a partial sectional view of the suitcase frame and a blocking element, FIG. 5B shows a partial sectional view of the blocking element, FIG. 5C shows a partial sectional view of a flexible element attached to an antennae element, FIG. 6 shows a sectional perspective view along the line VI in FIG. 5, FIG. 7 shows a perspective view along the line VII in FIG. 1.

The suitcase frame 1 consists substantially of two double walls 2 and 3 arranged parallel to and at a distance from each other, a bottom part 50 dividing the walls, and the U-shaped pulling bracket 10, which is coupled to an actuating system for the carrying wheels 6, 7 such that when the bracket 10 is extended (FIG. 2 and 3) the carrying wheels are in the active position and when it is in the retracted position (FIG. 1) the wheels are in the rest position. In the suitcase frame are a pair of cases, a comparatively larger case 45 and a comparatively smaller case, a so-called attache case, 47. The attache case 47 is removable (FIG. 1) and can be used as a case independently. The bottom wall 46 of the first case is preferably movable using the bellows construction 48 so that it can be moved as according to the arrow in FIG. 1 in order to be able to enlarge the packing space when the attache case 47 is absent. The whole can be carried using the carrying grip 52, which is movable in the slot 53. Depending on the presence of the attache case 47 the carrying grip 52 can be placed in the slot 53 in the most favourable position relative to the centre of gravity.

In the rest position the carrying wheels 6, 7 are held in the space 4, 5 in the respective double walls 2, 3. In the rest position the access space for the wheels is closed off by the respective flaps 54 and 55. The flap is biased to the closed position. The suitcase displays on one side a rounded form 49 such that when the suitcase is placed against a seat in an airplane the user sitting on the seat is not obstructed.

Arms 56, 57 are retractable into and extendable out of the bottom part 50, which arms can serve in the extended position (FIG. 3) to accommodate a third suitcase or bag lying separately on the suitcase frame.

The legs 11, 12 of the U-shaped bracket 10 consist of three telescopically extendable parts 28, 29, 30.

The actuating system 8 comprises a pivot arm 19 which is connected to the relevant carrying wheel 6. The pivot arm is pivotable around the pivot shaft 18 which is slidable in the slot 15. Present in the pivot arm 19 is a channel-shaped guiding track 17 in which can move a roller 20 connected to the bracket 10. When the bracket is pulled out the roller 20 moves in the channel-shaped guiding track 17 and forces this into pivoting to the outside and into a translation through the slot 15, whereby the movement initially is a mainly pivoting movement and in the latter portion of the path a translation movement through the slot 15. In the operative position of the carrying wheel, that is, the position outside the space between the double walls, the pivot arm is fixed in form fitting manner by co-action of the nose 21 and the recess 22 in the pivot arm. A similar fixation occurs in the rest position using the nose 23 and the recess 24. The wheels are arrested in their active position using a stop member 25 which is under the influence of the leaf spring 26 and which can pivot around the pivot shaft 58. During the movement to the active position the stop member 25 falls with the nose 59 behind the angle-shaped recess 27. When the bracket 10 is pushed inward the stop member 25 is pushed aside so that disengagement takes place. More particularly, the stop member 25 pivots about the pivot shaft 58 under the biasing force of the spring 26. This movement of member 25 is limited by the cooperation of the nose 59 and the recess 27. Upon retraction of the wheels, the stop member 25 is decoupled by the downward movement of the bracket 10. The underside of the bracket has an inclined surface 79, as shown in FIG. 5, and hits member 80, as shown in FIG. 4, which in turn causes stop member 25 to pivot about shaft 58 and delock the wheels 6, 7.

FIGS. 4A–4C show the translational movement of the rotating shafts 75, 76 of the wheels 6, 7. Upon pulling the bracket 10 the roller 20, which is connected to the lowermost part of the telescopical bracket, and travels in the channel-shaped guiding track forcing the pivot arm 19 to move therewith. This causes the pivot arm to move outwardly and in turn causes the wheels 6, 7 and their respective rotating shafts 75, 76 to move translationally with respect to the frame 1. The movement of the pivot arm 19 is limited by the cooperating recesses and noses 22, 21, and 24, 23.

As can be seen for example from FIG. 4, in the rest position the body 44 of the U-shaped bracket is recessed into the groove 60. The bracket 10 is fixed in this position by two commercially available two-part latches 13*a* and 13*b*, 14*a* and 14*b*. Springs 62, 63 between the second telescopic part 29 of each leg 11, 12 of said bracket 10 and the bottom part 50 of said frame 1 ensure that said bracket 10 pops up upon release of said latches 13, 14.

For fixing the U-shaped bracket 10 in its fully extended position, fixation means 9 is provided. FIGS. 5 and 6 show one embodiment of the fixation means 9. In this embodiment the bottom part 50 of the suitcase frame 1 is provided with a doubler element 31 in line with each leg 11, 12 of the bracket 10, each said doubler element 31 being provided with a threaded opening 32 accommodating an adjustment screw 33. To the adjustment screw 33 is attached one end of the thinnest member 34 of a commercially available telescopic antenna 36, mounted inside the U-shaped bracket 10. To the other end of said thinnest antenna member 34 a flexible element 37 is attached, which runs along the inside of said telescopic antenna 36 in a snug fit, and which continues in a snug fit along the inside of tubular members 38, 39 that are connected to antenna 36 and that run the length of the body 44 of said U-shaped bracket 10. The length of the flexible element 37 is such, that when the bracket 10 is retracted, said flexible element 37 passes through a blocking element 40, but that when said bracket 10 is fully extended, said flexible element 37 stops just short of said blocking element 40. The blocking element 40 comprises a body 65, provided with at least one hole 66 running the length of said body 65, said body 65 being movably mounted in the body 44 of the U-shaped bracket 10 in such a way, that when said body 65 is in a first position, extending partly through an opening 67 in the lower skin of said body 44 of said bracket 10, said body 65 acts to block the passage between the tubular members 38, 39, thereby prohibiting movement of said flexible element 37, whereas when said body 65 is in a second position, completely sunk into the body 44 of bracket 10, the hole 66 in said body 65 acts as a passageway between the tubular members 38, 39, thus allowing movement of said flexible element 37 through said tubular members 38, 39. The body 65 of blocking element 40 is spring mounted in the bracket 10 by a biasing spring 61. The biasing spring 61 is relaxed when the blocking element 40 is in a first position, blocking the passage through the guiding tracks 43, 51 so that the blocking element 40 is biased to a passage blocking position, and the biasing spring 61 is loaded when the blocking element 40 is in a second position, clearing the passage through the guiding tracks 43, 51. In other words, the telescopically slidable guide 36, and tubular members 38 and 39 mounted in the bracket 10 form a guiding track 43. The flexible element 37, which is made of a flexible material, snugly fits in the guiding track, and one end of the flexible element 37 attaches to or fixes to the beginning of the guiding track 43 near one side of the bottom part 50 of the frame 1. Likewise, the suitcase frame 1 also includes a guiding track 51 formed of telescopically slidable guide 36*a*, and tubular members 38*a* and 39*a* mounted to bracket 10 which is parallel with the guiding track 43. A flexible element 41, which is made of a flexible material, snugly fits in the guiding track, and one end of the flexible element 41 attaches to or fixes to another side of the bottom part of 50.

FIGS. 5A through 5C show the function of flexible element 37. In FIG. 5B the flexible element 37 is blocked. Upon movement of the member 65 upwardly the hole 66 is aligned with the flexible element 37 so that element 37 can pass through the hole 66 and upon retraction of bracket 10, the flexible element 37 passes therethrough. The length of the flexible element 37 is such that, if the bracket 10 is fully extended, the flexible element cannot pass through the hole 66 since the blocking element 40 including member 65 moves downwardly under biasing force of the spring 61.

The suitcase 45 is provided with an extra security measure in the form of a chain or cable 68 closable around for example a post or pillar or the like. In the rest position the cable 68 is wound around a biased spool 69 (FIG. 7). By operating the combination lock 70 the panel 71 can be moved outwards, the cable 68 can be pulled from the spool and the loose end placed in a locking opening 72. Subsequently the panel 71 is closed again.

We claim:

1. A suitcase frame, comprising a first double wall having a carrying space, a bottom part connected to said double wall, a carrying wheel pivotally attached to said first double wall so that said carrying wheel can pivot between a rest position in the carrying space of said first double wall and an active position outside that space, means for actuating and causing said wheel to pivot, said means including a pivot arm connected to said wheel and pivotally connected to said double wall, said pivot arm having a channel-shaped guiding track, a roller received by and movable within said guiding track and a bracket connected to said roller, and means for fixing said bracket in a fully extended position when said first wheel is in the active position, comprising a first guide track including a telescopically slidable guide mounted to said bracket, a flexible element having one end mounted near said bottom part and slidably received by said first guide track, and a blocking element mounted to said bracket, said blocking element having a flexible element receiving bore movable between a first position which permits another end of said flexible element to pass through said bore and a second position which prevents said other end of said flexible element from passing through said bore, said flexible element having a length such that when the bracket is in the fully extended position said flexible element other end cannot enter said bore.

2. The suitcase frame of claim 1 further comprising a second double wall having a carrying space connected to said bottom part and arranged parallel to and at a distance from said first double wall, a second carrying wheel pivotally attached to said second double wall so that said second carrying wheel can pivot between a rest position in the second double wall carrying space and an active position outside the second double wall carrying space and means for actuating and causing said second wheel to pivot.

3. The suitcase frame of claim 1 wherein said bracket is slidable to an extended position and a retracted position in a lengthwise direction within said first double wall, so that when said bracket is extended in the extended position said first carrying wheel is in the active position outside said first carrying space and when the bracket is retracted to the retracted position said first carrying wheel is in the rest position inside said first carrying space.

4. The suitcase frame of claim 3 wherein said bracket includes a telescopic leg attached to said roller.

5. The suitcase of claim 1 further comprising means for positioning said pivot arm in the active position and in the rest position.

6. The suitcase of claim 5 wherein said means for positioning said pivot arm in the active position and in the rest position include a stop member pivotally mounted to said first double wall and a spring mounted to said stop member, and a stop member receiving recess in said pivot arm whereby when said carrying wheel is in the rest position said stop member is disengaged from said stop member receiving recess of said pivot arm and when said carrying wheel is in the active position said spring acts upon said stop member to bias the stop member into engagement with said stop member receiving recess of said pivot arm and thereby locking the wheels in an active position.

7. The suitcase of claim 5 wherein said means for positioning said pivot arm in the active position and in the rest position include a first nose member and a second nose member mounted to said first double wall and said pivot arm includes a first nose receiving recess and a second nose receiving recess whereby when said first wheel is in the rest position said first nose is received by said first nose receiving recess and when said first wheel is in the active position said second nose is received by said second nose receiving recess.

8. The suitcase frame of claim 1 wherein said means for fixing said bracket in a fully extended position when said first wheel is in the active postion further includes a second guide track having a telescopically slidable guide mounted to said bracket and positioned parallel to said first guide track, and a second flexible element having one end mounted near said bottom part so that said mounted ends of said first and second flexible elements are positioned away from each other on opposite sides of said bottom part.

9. The suitcase frame of claim 1, wherein said means for fixing said bracket in a fully extended position when said first wheel is in the active position further includes a blocking spring mounted in said bracket which contacts said blocking element whereby when said blocking spring is in a relaxed state said blocking element is in the first position, blocking the passage for said flexible element other end through said flexible element receiving bore, and when said blocking spring being in a loaded state said blocking element in a second position, clearing the passage for said other end of said flexible element to pass through said flexible element receiving bore.

10. The suitcase frame of claim 1, wherein one end of said telescopic guide is threadably mounted to said first double wall.

11. The suitcase frame of claim 1 further include latches mounted to said bracket.

12. The suitcase frame of claim 1 further including a second spring mounted to said first double wall whereby said second spring is maintained in a loaded state against said bracket when said bracket is in a retracted state and said second spring is maintained in a relaxed state when said bracket is in an extended state.

13. The suitcase frame as claimed in claim 2 wherein a first suitcase is defined by said first double wall and said second double wall and the spacing therebetween.

14. The suitcase frame as claimed in claim 13 wherein said first double wall and said second double wall form two side walls of said first suitcase.

15. The suitcase frame as claimed in claim 13 wherein a second suitcase is releasably attached to said first and second double walls.

16. The suitcase frame as claimed in claim 14 wherein said first suitcase has a displaceable bottom connected to said side walls by means of a bellows construction.

17. The suitcase frame as claimed in claim 14 wherein said first suitcase has a rounded upper wall connected to said side walls.

18. The suitcase frame of claim 13 wherein said bottom part forms a bottom wall of said first suitcase.

19. The suitcase frame of claim 13 wherein said first suitcase further includes a handle attached thereto and received by a handle receiving slot.

20. The suitcase frame of claim 1 further including extendable carrying arms attached to said bottom part.

21. The suitcase frame of claim 2 wherein said bracket is U-shaped.

22. A suitcase frame, comprising a first double wall having a carrying space, a bottom part connected to said double wall, a carrying wheel pivotally attached to said first double wall so that said carrying wheel can pivot between a rest position in the carrying space of said first double wall and an active position outside that space, means for actuating and causing said wheel to pivot, said means including a pivot arm connected to said wheel and pivotally connected to said double wall, said pivot arm having a channel-shaped guiding track, a roller received by and movable within said guiding track and a bracket connected to said roller, and means for positioning said pivot arm in the active position and in the rest position including a stop member pivotally mounted to said first double wall and a spring mounted to said stop member, and a stop member receiving recess in said pivot arm whereby when said carrying wheel is in the rest position said stop member is disengaged from said stop member receiving recess of said pivot arm and when said carrying wheel is in the active position said spring acts upon said stop member to bias the stop member into engagement with said stop member receiving recess of said pivot arm and thereby locking the wheels in an active position.

* * * * *

UNITED STATES PATENT AND TRADEMARK OFFICE

CERTIFICATE OF CORRECTION

PATENT NO. : 4,979,598

DATED : December 25, 1990

INVENTOR(S) : Johannes W. Verheij and Irene P. van Peer

It is certified that error appears in the above-identified patent and that said Letters Patent is hereby corrected as shown below:

On the title page, Assignee: "Homas" should read --Homar--.

Signed and Sealed this

Fourteenth Day of July, 1992

*Attest:*

DOUGLAS B. COMER

*Attesting Officer*

*Acting Commissioner of Patents and Trademarks*